United States Patent [19]

Johnson

[11] 4,202,580

[45] May 13, 1980

[54] SEQUENCING LOCK FOR RECLINER

[75] Inventor: Carl B. Johnson, Pontiac, Ill.

[73] Assignee: Pontiac Furniture Industries, Inc., Pontiac, Ill.

[21] Appl. No.: 959,465

[22] Filed: Nov. 13, 1978

[51] Int. Cl.[2] ..... A47C 1/02

[52] U.S. Cl. ..... 297/84; 297/68; 297/318

[58] Field of Search ..... 297/83, 84, 85, 86, 297/87, 68, 61, 317, 318

[56] References Cited

U.S. PATENT DOCUMENTS

| | | | |
|---|---|---|---|
| 3,068,047 | 12/1962 | Schliephacke | 297/88 |
| 3,101,216 | 8/1963 | Schliephacke | 297/88 |
| 3,243,225 | 3/1966 | Katz | 297/75 |
| 3,363,942 | 1/1968 | Fletcher | 297/84 X |
| 3,730,585 | 5/1973 | Rogers, Jr. | 297/85 |
| 3,747,973 | 7/1973 | Re | 297/84 |
| 3,869,170 | 3/1975 | Johnson | 297/69 |
| 4,071,276 | 1/1978 | Cecil | 297/85 |

*Primary Examiner*—James T. McCall

*Attorney, Agent, or Firm*—Fitch, Even & Tobin

[57] ABSTRACT

The reclining chair disclosed is provided with a sequencing lock mechanism which prevents recline of the body support until the footrest is extended, and prevents retraction of the footrest until the body support is righted. Control is effected by a compound slot which confines a pin movable in two separate modes by the footrest and by the body support to two distinct paths corresponding to footrest and body support movement.

3 Claims, 5 Drawing Figures

SEQUENCING LOCK FOR RECLINER

This invention relates to reclining chairs and particularly to a control mechanism for such chairs which governs the sequence in which the various adjustments of its several parts can be performed.

Mechanisms for sequencing are useful in a number of kinds of reclining chairs, particularly where the adjustment of the chair parts into a reclining attitude requires coordination with other movements of which the chair, as a whole, is capable.

For example, in so-called rocker-recliners, the chair is capable of use either as a rocker or a recliner, but typically not both at the same time, due to problems of balance which could result in overturning the chair. In such chairs, the rocking function is preferably disabled by the extension of the footrest, which must accordingly precede the recline of the backrest.

In another context, the so-called wall-clearing recliner, the ability of the chair to stand with its backrest in close adjacency to a wall or other obstruction depends upon the ability of the chair, as a whole, to move forward on its normally stationary underframe, either simultaneously with or preceding the recline of the backrest, in order to prevent collision with the wall.

The present invention provides, in the setting of a reclining chair adaptable to either of those purposes, a mechanism which is associated both with the extensible and retractable footrest of the chair and with its reclinable body-supporting portions so as to require that the footrest first be extended to condition the chair for recline. Similarly, the sequencing mechanism of the present invention also requires that the chair, after having been placed in a reclining attitude, first have its body-supporting portions restored to upright sitting attitude as a preliminary to the retraction of the footrest.

It will be appreciated that this sequencing, considered in the context of a rocker-recliner, restores the center of gravity of the chair and its occupant comfortably within the rocking ambit of the chair, and, in the context of a wall-clearing recliner, essentially requires that the backrest of the chair be righted before the return movement of the chair body, as a whole, to its sitting position close to the wall.

The invention and its attainment of the foregoing objectives will be understood from the ensuing description, made in reference to the accompanying drawings (2 sheets) in which FIGS. 1(*a*) to 1(*c*), inclusive, are a series of interior elevational views of a chair mechanism of the wall-clearing type embodying the invention;

FIG. 1(*a*) illustrating the mechanism in the normal sitting position, i.e., in the relative association of the chair parts when the chair is conditioned for placement against or near a wall or other obstruction;

FIG. 1(*b*) illustrating the same chair with its footrest fully extended, and with the chair body forward on its footings; and FIG. 1(*c*) illustrating the same chair fully reclined;

FIG. 2 is a fragmentary enlargment of FIG. 1(*a*), having also indicated thereon by broken lines certain parts of the mechanism as subsequently positioned to correspond with FIGS. 1(*b*) and 1(*c*); and FIG. 3 is a sectional elevation taken along the line 3—3 of FIG. 2.

GENERAL DESCRIPTION OF THE INVENTION AND ITS APPLICATION

The wall-clearing recliner chosen to illustrate one specific application of the invention comprises a normally stationary metal underframe 10 which provides, in effect, a forwardly and downwardly sloping roller track surmounted by a movable carriage 12. For purposes of the appended claims, that carriage is the "base" of the chair.

As indicated by a quick comparison of FIGS. 1(*a*) and 1(*b*) of the drawings, the carriage or "base" is movable forwardly on its sloping roller track under the effect of gravity upon the release of an appropriate latch. In the process, the chair body as a whole moves away from the wall so that the backrest of the chair can be reclined without striking the wall.

In the other context earlier mentioned, i.e., the rocker-recliner, the "base" would be the rocking portion of the underframing of the chair, irrespective of its particular form.

Mounted upon the base or carriage 12 by means of suitable supporting linkage is the body-support 14 of the chair, comprising, in the illustrated instance, a seat member 16 movably mounted on the base and a backrest 18 connected to the seat and also to the base so that both the seat and the backrest move relative to the base and also to each other in the adjustment of the chair from the upright sitting position of FIG. 1(*a*) into the ultimate, fully reclined position of FIG. 1(*c*).

The footrest 20 is carried on a pair of rails 22 movably mounted beneath the seat, and is extended and retracted by an operating lever 24 acting upon the movable support rails through linkage such as that disclosed in U.S. Pat. No. 3,869,169, issued to me jointly with Henry James, and assigned to the assignee of this invention.

The footrest 20 derives its movement from the hand lever at the side of the chair independently of any movement of the body-support 14 of the chair into or toward a reclined position.

Thus to employ this invention to advantage, a recliner would comprise minimally an extensible and retractable footrest actuated independently of the recline of the body support, a body support including a seat and a backrest irrespective of whether they are movable relative to each other during the recline of the chair, and a base which supports the aforementioned chair parts either directly or indirectly, depending upon the respective mountings of the footrest and of the seat and backrest, of which there are myriad forms already known in the art.

In the illustrative wall-clearing recliner, as already noted, the carriage 12 moves forward under gravity upon the release of a latch 26 disengaged by the extension of the footrest. Thus, as an incident to the first step in conditioning the chair for recline, i.e., the extension of the footrest to support the occupant's legs, the body of the chair moves forward by gravity to provide the necessary clearance. More specifically, in terms of the mechanism to assure this result, the chair cannot be reclined until it is so first conditioned by the extension of the footrest, which, in turn, is accompanied by the forward movement of the chair body as a whole.

DETAILED DESCRIPTION

Figure 1A:
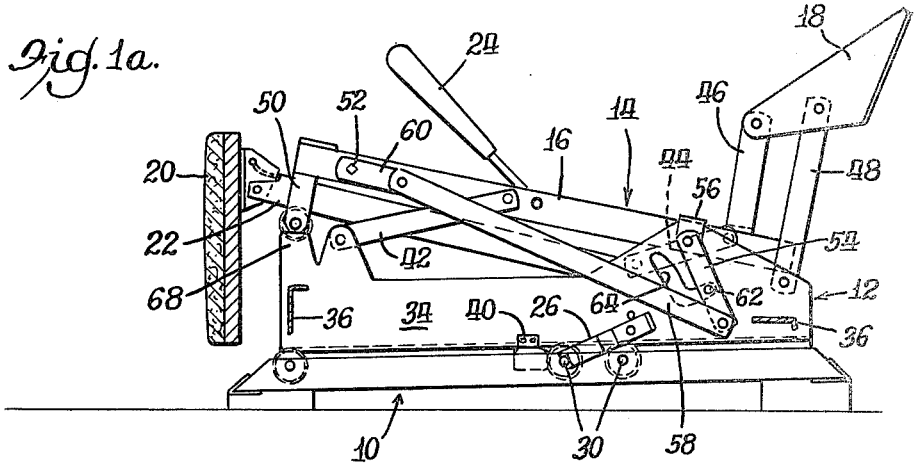
Figure 1B:
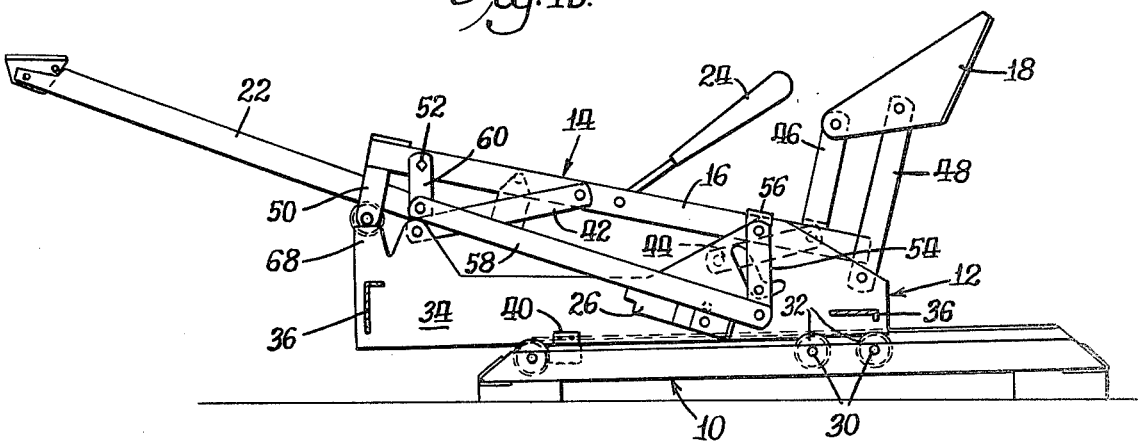
Figure 1C:
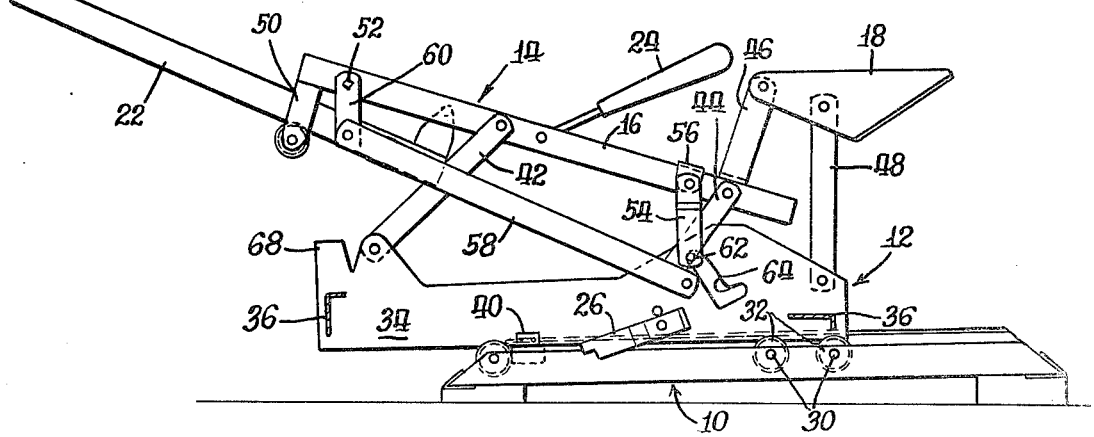

FIGS. 1(*a*) through 1(*c*) of the drawings (first sheet) show one side of the operating mechanism from the inside of the chair, and it should be understood that that mechanism is duplicated in mirror image on the opposite side of the chair, with the exception of the illustrated footrest operating lever 24, which is mounted for use by the occupant's right hand.

The roller tracks, on which the chair as a whole is movable forward and back, are provided by the side rails 28 of the normally stationary underframe 10 resting upon the floor. The side rails are channel-shaped (FIG. 3), the exterior flange thereof being taller than the interior one and being folded over to provide an inwardly-extending ledge. Pins 30 passed through the two flanges provide axles for three supporting rollers 32, one at the forward end of the side rail and two in tandem medially of the rail in the area of the more concentrated load.

The carriage or base 12 of the chair comprises a pair of sideplates 34 connected together by suitable cross-members 36 to comprise a stable base mounted on the rollers 32 of the underframe. For this purpose, each sideplate of the carriage is bent outwardly along its lower edge to form an extended longitudinal flange which rides on the rollers of the underframe. The outwardly turned flange of the carriage sideplate and the inwardly turned overlying flange of the side rail of the underframe are inter-leaved (FIG. 3), and the rollers 32 of the underframe provided with a single interior flange 38 of depth greater than the loaded distance between the interleaved flanges of the carriage and underframe, to insure the maintenance of the assembled relationship. Travel of the carriage between the positions of FIGS. 1(*a*) and 1(*b*), is limited by a bumper 40 which is secured to the sideplate of the carriage, fitting inside the side rails of the underframe for engagement with the forwardmost one of the two rearward rollers in the position of FIG. 1(*a*), and with the forward roller in the positions of FIGS. 1(*b*) and 1(*c*).

In the illustrated chair, the seat 16 and the backrest 18 are movable relative to each other, as well as to the carriage when the chair is reclined. The side members of the metal seat frame 16 are supported upon the carriage by a pair of links 42 and 44 of unequal length pivoted to the seat frame and to the carriage sideplates so as to constitute a four-bar linkage which gives the seat a fixed path of movement relative to the carriage. In the positions of FIGS. 1(*a*) and 1(*b*), the seat frame is actually resting on the carriage, i.e., its weight and the load which it carries when in the sitting position are transferred directly to the carriage sideplates 34 essentially independently of the two supporting links 42 and 44, by means which are more conveniently described later on.

The backrest 18 is povited directly to an upstanding post 46 secured to the seat frame 16 near the rear thereof, and the backrest is connected to the carriage by an upstanding link 48 pivoted both to the backrest and to the carriage sideplate. These connections determine a fixed path of movement of the backrest relative to the base or carriage 12 so that as pressure is placed against the backrest 18 to cause it to recline, it, in turn, lifts the seat 16, which moves upwardly and forwardly relative to the base through the path determined by its supporting links 42 and 44, and carries the lower end of the backrest forwardly with the seat in the process.

The recline linkage just described is not, in its specific form, a part of the present invention, being separately disclosed and claimed in my copending application Ser. No. 885,586, filed Mar. 13, 1978.

The footrest 20 of the chair is disposed at the front of the chair below the level of the seat when the chair is in the sitting position. As earlier noted, it is carried on the ends of the rails 22 which are roller-mounted in part on brackets suspended from the front of the seat so as to thrust the footrest forwardly of the seat to an extended leg supporting position, and to retract the footrest, in turn, upon the manipulation by the occupant of the hand lever 24 at the side of the chair.

A specific mechanism for this purpose is illustrated in U.S. Pat. No. 3,869,169, issued March 4, 1975 to me jointly together with Henry James, and assigned to the assignee of this invention. It will, therefore, be sufficient for present purposes to note that the footrest, being supported by the two extensible rails, is driven forwardly and rearwardly by identical linkages at opposite sides of the chair, whose movements are synchronized by a horizontal cross-shaft 52 journaled in the seat frame, extending from side to side of the seat at the front thereof. In said U.S. Pat. No. 3,869,169, and as well in the chair here shown as illustrative of the setting of the invention, that shaft, shown in cross-section in FIGS. 1(*a*), 1(*b*) and 1(*c*), is square, and turns through approximately 90° by the movement of the operating lever 24 to extend the footrest, i.e., in the movement of the parts from their positions in FIG. 1(*a*) to their positions in FIG. 1(*b*).

The sequencing lock which is the focus of the present invention takes the form of a locking link 54 which is pivotally suspended from a bracket 56 secured to the seat 16 just forwardly of the post 46 to which the backrest is pivoted. The locking link 54, at its end remote from its pivotal attachment to the seat, is pivoted to a long connecting link 58 which extends forwardly and upwardly for pivotal attachment to a crank arm 60 secured to the synchronizing cross-shaft 52 at the front of the seat frame.

Figure 3:
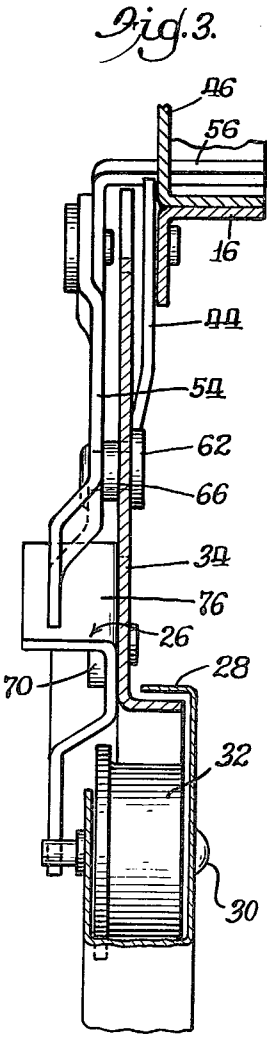
Figure 2:
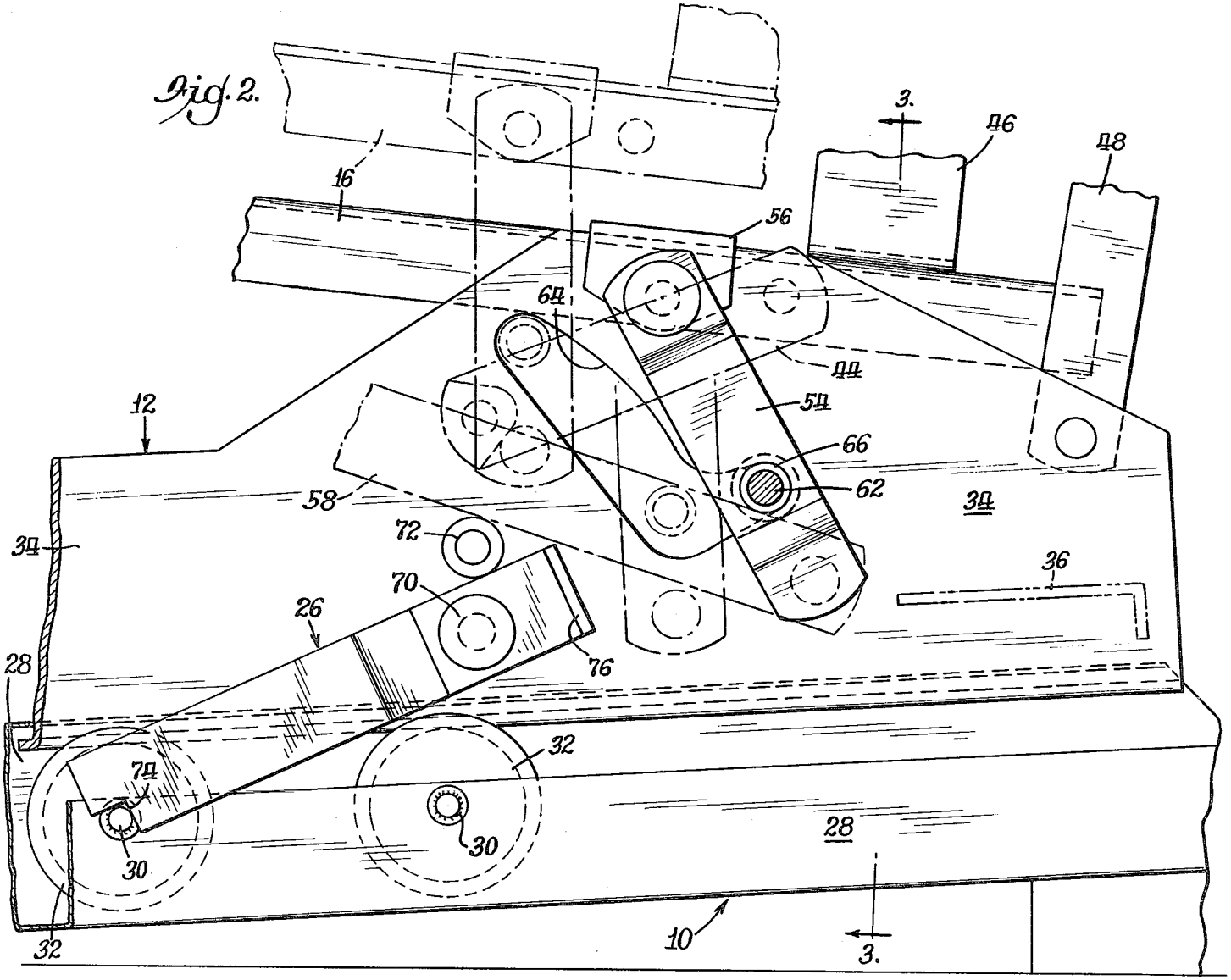

Between its pivotal attachment to the seat bracket 56 and its pivotal attachment to the connecting link 58, the locking link 54 is provided with a sidewardly extending locking pin 62 engaged within a specially formed L-shaped compound slot 64 in the carriage sideplate (see FIGS. 2 and 3). The locking pin 62 is in the form of a headed shoulder rivet, having on its shank a bushing 66 of molded nylon, or the like, for smooth rolling contact with the edges of the slot 64 in which the pin is emplaced.

The form of the slot 64 is dictated by the separate modes of movement of which the locking pin 62 is capable as a result of its connections to the footrest extension mechanism 52, 60, on the one hand, and its connection to the seat 16, on the other, the latter, of course, being movable relative to the carriage or base upon the recline of the chair.

Specifically, when the footrest is extended, the synchronizing shaft 52 at the front of the seat frame of the chair, as earlier noted, is turned approximately a quarter turn, which, through the arm 60 thereon, draws the connecting link 58 forwardly, and with it the locking link 54 to which the locking pin 62 is secured. On the other hand, when the chair is reclined, the rearward turning movement of the backrest 18 produces an upward and forward movement of the seat 16, which is transmitted to the locking pin 62 by the pivotal attachment of the locking link 54 to the seat bracket 56.

To perform its sequencing function, therefore, the slot 64 is shaped so that when the chair is in the sitting position, the only permissible adjustment of the chair is the extension of the footrest by the hand lever 24. For this purpose, the slot 64 is shaped to prevent any upward movement of the seat frame, and thus any recline of the backrest, from the sitting position while the footrest is retracted. That position of the respective parts is shown in FIG. 1(*a*), and in enlarged detail in FIG. 2, from which it will be seen that, in the sitting position, the locking pin 62 is snuggly overlain by the carriage sideplate, which directly opposes any movement of the seat frame along its predetermined upward path of movement.

Upon the extension of the footrest, however, accompanied by the forward swing of the locking link 54, the locking pin 62 is moved into the area of the convergence of the two portions of the L-shaped slot 64, removing the restriction so that upward movement of the seat frame in its predetermined path is possible. That upward movement of the seat frame, with the footrest fully extended, likewise prescribes the path of movement of the locking pin 62 inasmuch as all of the link members which support and position the stop pin are suspended from the seat. The second portion of the compound slot is accordingly shaped so that it will freely permit the upward movement of the locking pin 62, the rear edge of the upward extending portion of the slot following closely the path of movement of the locking pin during its upward movement occasioned by the rise of the seat upon recline of the backrest of the chair. By following in close contact with the lock pin, the border of the slot in its upper portion prevents the rearward swing of the locking link, and thus prevents the retraction of the footrest while the chair is reclined.

It will be apparent that if the operative edges of the slot were determined solely by the path of movement of the locking pin through a first arc coincident with the extension of the footrest, and a second intersecting arc coincident with the recline of the body-supporting portion of the chair (the elevation of the seat) with the footrest fully extended, the edges of the carriage plate bordering the slot along its interior angle would define a cusp at the juncture of the two slot portions. For functional reasons in the operation of the chair, as well as with regard to wear and tear on the engaged parts, the edge of the carriage plate bordering the interior angle of the two slot portions is relieved in a smooth curve at their convergence. This relief not only permits a certain amount of freedom in the position of the footrest relative to the attitude of the recline of the chair, i.e., permits a limited recline without full extension of the footrest, a useful attitude of the respective chair parts, it also provides a camming action in which the retraction of the footrest with the body-support of the chair in partial recline forceably hauls the body-support into the upright sitting position, and conversely, the recline of the chair when the footrest is partially retracted forces the footrest to full extension.

The portion of the carriage plate bordering the exterior angle of the L-shaped slot is of relatively minor importance, and may depart from the path traveled by the locking pin, inasmuch as the position of the locking pin at the intersection of the center lines of its two permissible arcuate paths is not determined by the engagement of the locking pin with the forward and lower borders of the slot, but rather by other limits upon the extension of the footrest and by the direct support of the seat frame by the carriage when in the upright sitting position. Those borders, however, return snugly to the locking pin at the opposite extremities of the compound slot, so that the head of the lock pin can effectively resist any incidental side thrust on the locking pin which may result from slight misalignment of the parts as a result of tolerances of manufacture and assembly, or from deflections of the parts under load.

The aforementioned direct support of the seat frame 16 by the carriage 12 when the chair is in sitting position is provided at the front and near the rear of the seat frame. At the front, the axle pin of the bracket 50 of the forward support roller for the footrest rail rests upon a seat 68 sidewardly offset from the upper front corner of the carriage sideplate 34. Toward the rear, the bracket 56 to which the locking link 54 is pivoted overlies and rests firmly upon the upper edge of the carriage sideplate 34, so that neither the seat support linkage 42–44 nor the locking link 54 bear any of the occupant's weight in that position.

The releasable latch 26, seen in all of the drawings, but best in FIGS. 2 and 3, is a gravity-operated detent pivoted to the carriage sideplate 34 by a shoulder rivet 70 beneath a stop rivet 72, which limits the rotation of the detent in both directions. In the normal or operative position of the detent (FIGS. 1(*a*), 2, and 3), a shoulder 74 formed by notching the nose of the latch, is positioned to ride over the axle pin 30 of the forward tandem roller 32, and to drop behind the pin 30 to secure the carriage 12 at its rearward, uphill position. A sidewardly bent tab 76 at the rear of the latch 26 is disposed for engagement and depression by the connecting link 58 when the footrest starts forward, and thus lifts the shoulder 74 clear of the axle pin 30, releasing the carriage 12 for forward and downward travel.

The features of the invention believed new and patentable are set forth in the appended claims.

What is claimed is:

1. In a reclining chair having a body support including a seat and a backrest, said body support being movably mounted upon a base for adjustment thereon between an upright sitting position and a reclining position, a footrest movable from a retracted position to an extended position to support the extended legs of the occupant, and means actuated by the occupant independently of the adjustment of the body support to move said footrest between said retracted and extended positions:

the improvement comprising a locking member connected both to the footrest and to the body support so as to have a first mode of movement relative to the base in response to extension and retraction of the footrest and a second mode of movement relative to the base in response to the movement of the body support between the sitting and reclining positions, and a connection between said member and said base substantially limiting the movement of said locking member in each said mode to a given path relative to the base, each of said two resulting paths permitting one mode of movement while preventing the other and converging at a point on both paths corresponding to the extended position of the footrest, the arrangement thereby requiring the extension of the footrest as a preliminary to recline of the body support, and the righting of the body support as a preliminary to retraction of the footrest.

2. The improvement of claim 1 wherein said locking member comprises a pin on a first link pivotally connected to the body support, and the connection of the locking member to the footrest is a second link connected between said first link and said footrest-actuating means, and the connection of the locking member to the base is a plate on the base positioned parallel to the path of movement of said first link and having therein a compound slot of two converging slot portions defining the two paths of movement of the pin.

3. The improvement of claim 2 wherein the compound slot of said plate increases in width toward the convergence of the two slot portions thereby to accommodate a partial recline of the body support with partial extension of the footrest, and the portion of the plate comprising the interior angle of said convergence is relieved in a smooth curve to cam the body support from said partial recline into upright sitting position by the retraction of the footrest.

* * * * *